United States Patent [19]

Leon et al.

[11] 4,232,359

[45] Nov. 4, 1980

[54] SPOTLIGHT OR OTHER ILLUMINATOR

[75] Inventors: Gordon T. Leon, San Pedro; Joseph L. Byron, Burbank, both of Calif.

[73] Assignee: Berkey-Colortran, Inc., Burbank, Calif.

[21] Appl. No.: 28,329

[22] Filed: Apr. 9, 1979

[51] Int. Cl.[3] ..... F21V 7/00

[52] U.S. Cl. ..... 362/268; 362/281; 362/285; 362/307

[58] Field of Search ..... 362/287, 268, 281, 285, 362/307

[56] References Cited

U.S. PATENT DOCUMENTS 4,023,031 5/1977 Storey ..... 362/281

*Primary Examiner*—Stephen J. Lechert, Jr.

*Attorney, Agent, or Firm*—Neuman, Williams, Anderson & Olson

[57] ABSTRACT

A spotlight includes a housing with an illumination source moveably mounted therein and a lens assembly moveably mounted therein. One or more lenses are mounted in the lens assembly, each in one of a plurality of predetermined positions. Independent movement of the source and lenses conveniently provides a variety of field angles, light outputs, or other illumination characteristics. A reflector, framing shutters, iris, pattern grids, and color filter gels may also be used as desired.

17 Claims, 4 Drawing Figures

SPOTLIGHT OR OTHER ILLUMINATOR

BACKGROUND OF THE INVENTION

This invention relates generally to an illuminator, and more particularly to a spotlight or floodlight type of illuminator, as is typically used for theatrical lighting. Due to the artistic nature of the medium, it is desirable to have a versatile illuminator which provides a wide range of illumination effects, such as flat and peak fields, soft and sharp field edges, a variety of field angles or beam spreads, a variety of illumination intensities at the same distance, the ability to shape the field or project patterns, and the ability to color the light output. It is further desirable to accomplish all of these variations quickly and manually without the need for special tools or additional illuminators.

Such lights usually include a housing, illumination source and reflector, and one or more lenses. They may additionally include shutter blades, pattern grids, or an iris in the vicinity of the lens focal point to shape the light output or control its intensity. Color filter gels may be used where convenient.

In the past, the lamps used in these illuminators were relatively large because of the large filaments or discharge areas necessary to produce sufficient light output. Incandescent lamps contained a lengthy filament supported to form a large grid, and discharge lamps contained a lengthy discharge area between electrodes. While the position of the actual illumination source with respect to the spotlight optics was important, due to the large size of the source, position was not as crucial as it is today with smaller sources, such as HMI lamps and smaller, higher output incandescent lamps. For instance, see U.S. Pat. No. 2,114,963 issued to J. Levy in 1938, which discloses a lamp that is firmly positioned with no means for adjustment.

As illumination sources became more compact and approached a more ideal point source, their position within the illuminator became more critical and adjustment was necessary to optimize the light output of the spotlight optical system and desirable to achieve a variety of other illumination characteristics or effects. Such a positioning means is disclosed in U.S. Pat. No. 4,061,912 issued to Levasseur, but it is more complex than the present invention, and demands exacting techniques to manufacture and position a spherical rear wall having its geometric center at the center of the reflector access opening.

Moveable lenses are disclosed in U.S. Pat. No. 2,114,963 issued to Levy, U.S. Pat. No. 2,650,292 issued to Strong, U.S. Pat. No. 3,116,022 issued to Davis, and U.S. Patent Application Ser. No. 739,694, filed Nov. 8, 1976, and assigned to the present applicants' assignee. However, each of these patents discloses lenses in a fixed or predetermined relationship with one another, the lamp, or both. Therefore, in order to change the focal length or field angle, or alter the light output or illumination characteristics of these devices, it is necessary to dismantle the spotlight and purchase another spotlight or optical system.

SUMMARY OF THE INVENTION

Accordingly, it is an object of the present invention to overcome the limitations and disadvantages of the prior art.

It is another object of the present invention to provide a spotlight having a wide range of selectable illumination characteristics and effects.

It is another object of the present invention to provide a spotlight having a moveable illumination source and a moveable optical system having one or more lenses, with each lens in said optical system also independently moveable.

It is another object of the present invention to provide a compact spotlight that is easy to handle and adjust, inexpensive to manufacture, and practical and efficient in use.

These and other objects will become apparent upon reading the following detailed description and appended claims, and upon reference to the accompanying drawings.

The present invention overcomes the drawbacks of these prior art systems by providing a housing with lamp support means and lamp focus means removeably mounted therein for movement of the illumination source to provide a variety of effects, including variations of the field edge, field, or illumination. A lens holding assembly is also moveably mounted in the housing and contains one or more lenses, each in one of a plurality of predetermined positions to provide a still further variety of effects including variations of the beam angles, illumination, or field. A light output control means is also mounted in the housing and has an access opening to receive the illumination source. The light output control means may include a shutter, iris, reflector, or pattern.

DESCRIPTION OF THE DRAWINGS

For a more complete understanding of this invention reference should be had to the embodiment illustrated in greater detail in the accompanying drawings as briefly described below.

DESCRIPTION

The following detailed description is illustrative of the best mode presently contemplated of carrying out the invention, and is not to be interpreted in a limiting sense.

Figure 1:
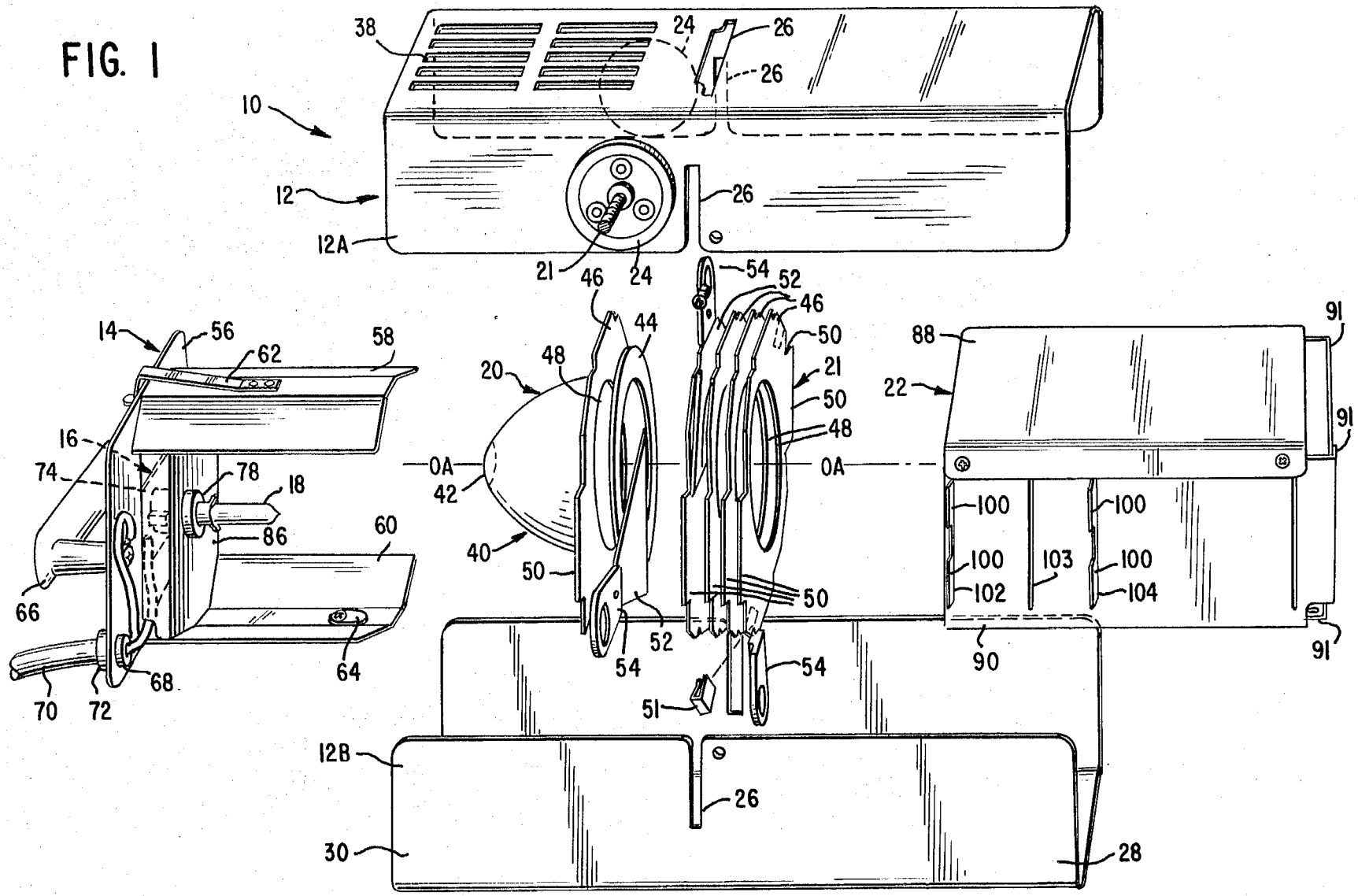
FIG. 1 is a partially exploded perspective view of a spotlight made in accordance with the teachings of the present invention. The lens holding assembly, lamp support means, and lamp focus means are shown in their assembled state.
Figure 2:
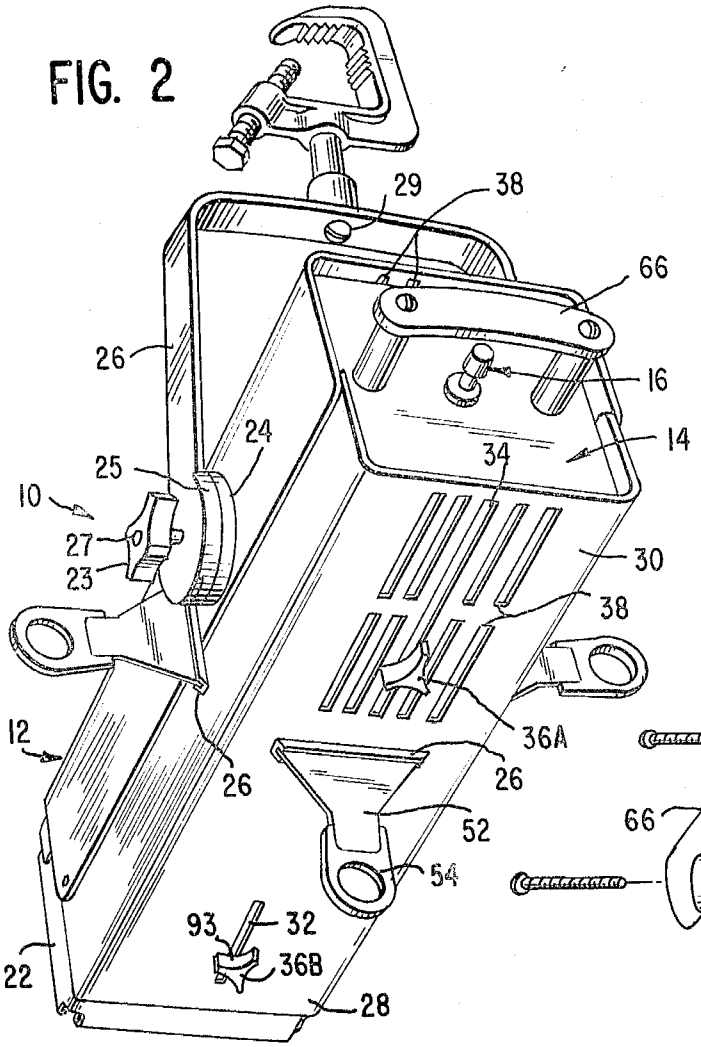
FIG. 2 is a perspective view of a spotlight made in accordance with the teachings of this invention.

Referring to FIGS. 1 and 2, a spotlight 10 generally includes a housing 12 comprising a first portion 12A and a second portion 12B. A lamp support means 14 is removably mounted in a first end of said housing 12 and includes a lamp focus means 16 and an illumination source 18. A light output control means 20, including a reflector assembly 40, is removably mounted in the mediate portion of the housing 12, and may include a shutter assembly 21 as shown. A lens holding assembly 22 is removably mounted in a second end of the housing 12 and includes one or more lenses (see FIG. 4).

The housing 12 is generally linear and comprises a first portion 12A and a second portion 12B that releasably clamshell together to form a tube open on each end and having a generally rectangular cross-section. The portions 12A and 12B may be retained by any convenient fastening means such as screws. The housing may consist of any convenient number of parts and assume any convenient shape or length, as will be apparent. As shown, the illumination source, reflector, and lens holding assembly together define an optical axis OA which coincides with the longitudinal axis of the housing. However, the use of mirrors or other optical elements permits one to reflect the light rays and fold the optical axis as desired while still enjoying the benefits of the invention. Such a folding is generally disclosed in U.S. Pat. No. 4,061,912, issued to Levausser.

The first portion 12A includes laterally positioned locking disks 24 or other pivot means on opposite sides that cooperate with a support yoke 26 to support or suspend the spotlight (see FIG. 2), as will be described later herein. Assembly slots 26 in the housing 12 retain the light control means 20 and the reflector assembly, and the shutter blades 52 and handles 54 extend therethrough for movement. Both ends of the housing, i.e. the lens end 28 and the lamp end 30, are unobstructed to permit removal and selective movement and retention of the lens holding assembly 22 and the lamp support means 14.

Referring still to FIGS. 1 and 2, in the second housing portion 12B, channels 32 and 34 each accommodate a threaded stud attached respectively to the lens assembly 22 and lamp support 24. Threaded onto each stud is a heat insulated star-wheel 36B, 36A to selectively slide and clamp the respective subassemblies in a desired position. Any convenient releaseable retaining means may be substituted for the stud and star-wheel means. Cooling slots 38 in both the first and second halves 12A and 12B permit ambient air flow to cool the lamp 18 by convection. Forced air cooling is unnecessary but may be provided if desired; such is well known to those skilled in the art.

A light output control means 20 generally includes a reflector 40, a shutter assembly 21, and may optically include a pattern grid or iris. The reflector 40 is usually a conic section of revolution and may be ellipsoidal, paraboloidal, or spherical. The reflector has a rear access opening 42, for insertion of an illumination source such as a lamp, and an annular peripheral lip 44 at its open end. A plurality of shutter dividers 46 each has a relatively large central hole 48 which may be of the same general diameter as the reflector at its open end. A plurality of housing capture tabs 50 at the periphery of each divider extend through the reflector assembly slots 26 to retain the dividers in position. The lip 44 of the reflector 40 is sandwiched between the two dividers 46 closest to the lamp, thereby retaining the reflector in position. The divider holes 48 are concentric when the dividers 46 are positioned in the housing, and they align with the optical axis OA.

One or more shutter blades 52 may be inserted between each pair of dividers 46, but it is desireable to use only a single blade between each of said dividers to eliminate interference between the blades. Each blade has a handle 54, preferably of heat insulating material. A retainer, such as a spring clip 51, compresses the dividers and provides sufficient friction to hold each shutter in its selected position. The shutters may be inserted into the light path to provide framing as desired, and may have an edge of any shape. The shutter assembly 21 is relatively thin, yet each shutter may travel in its own track and move without interferring with the other shutters. The handle 54 for each shutter extends through a reflector assembly slot 26 in the housing 12 and is easily accessible for manipulation.

The entire shutter assembly 21, as well as each individual shutter, may be removed as desired. A pattern or other grid may also be inserted into the light beam in addition to or in place of a shutter to provide a desired effect in a manner well known in the art.

Figure 3:
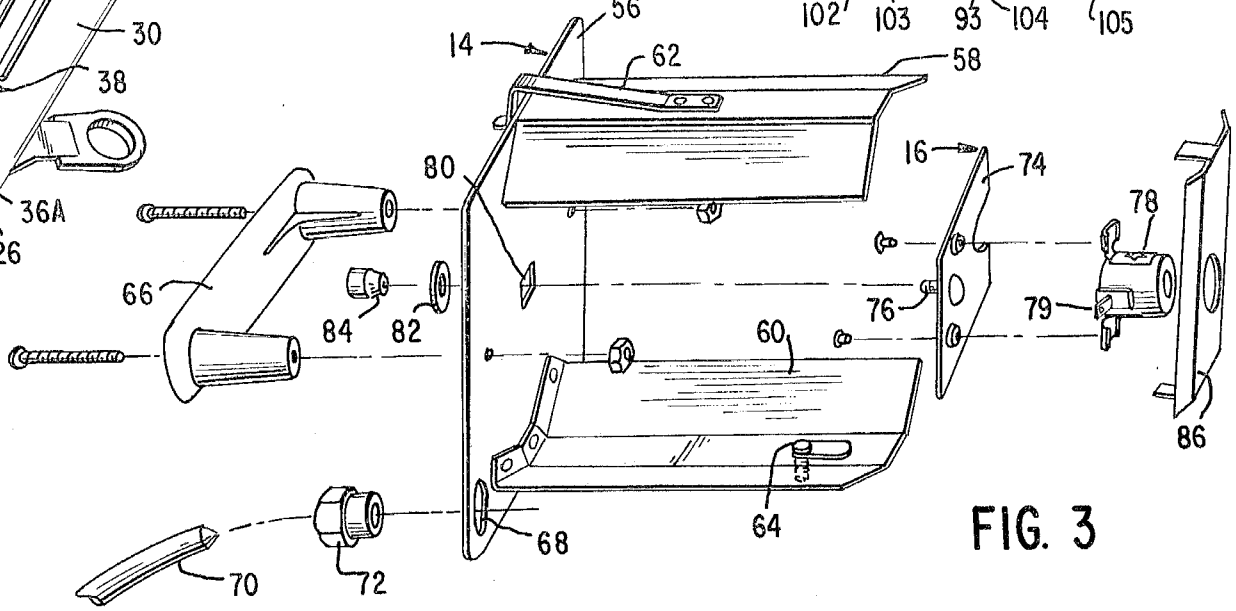
FIG. 3 is an exploded perspective view of a lamp support means and lamp focus means made in accordance with the teachings of the present invention.

Referring to FIGS. 1 and 3, and lamp support means 14 includes a back plate 56 having dimensions slightly smaller than the inside cross-sectional dimensions of the housing 12 measured perpendicular to the optical axis. Two guards 58 and 60 are attached to the back plate 56 and extend forwardly therefrom in a cantilevered fashion to protect the lamp and user and to help align the lamp support means 14 with respect to the housing 12. Guard 58 has a resilient spring clip 62 attached thereto which fits into one of the cooling channels 38 of the housing to prevent inadvertent removal of the lamp support means and to help align it with respect to the housing 12. The guard 60 has an attached stud 64 which extends through a slot 34 in the housing portion 12B. A heat insulating star-wheel 36A is threaded onto the stud 64 to releasably retain and position the lamp support means along the optical axis OA.

The easily grippable star-wheel 36A permits an operator to selectively move and secure the lamp support means while the lamp is on, as well as easily remove the entire assembly from the housing without special tools. This permits one to easily and rapidly change lamps or alter the light output characteristics. For example, one may create flat and peak fields, vary the beam angle, or achieve a fresnel type light by moving the lamp towards the lenses. This feature also allows the operator to compensate for variations in lamp filament placement and to position the illumination source as desired with respect to the reflector, i.e. in the focus. A heat insulating handle 66 is attached to the back plate 56 for convenient adjustment. An opening 68 provides access for a power cord 70 retained by strain relief means 72.

The lamp focus means 16 includes a socket plate 74 with a threaded bolt 76 or other projection rigidly attached thereto, and a lamp socket 78 attached to plate 74. The socket 78 includes electrical lead contacts 79 as necessary for connection to the power cord 70. The socket may be changed to accommodate a variety of lamps. The bolt 76 extends through an opening 80 in the back plate 56 of the lamp support means 14. The opening 80 has a general diameter or cross section several times the diameter of the bolt 76 to permit lateral movement therein. A large washer 82 and a correspondingly threaded easily grippable cap or star-wheel 84 permit an operator to selectively move and secure the lamp focus means 16 against the back plate 56. The sizes of the bolt 76, opening 80, and washer 82 may be varied as desireable to permit or limit the movement of the lamp focus means 16. This mounting permits selective radial movement of the lamp focusing means with respect to the optical axis. The radial movement of the lamp support means 14 and the longitudinal movement of the lamp support means 14 allows the lamp to be moved in three directions, offering maximum versatility and ease of use. Such adjustment is necessary to accurately position the lamp with respect to the reflector and desirable to produce certain off-axis effects, such as varying from a sharp to a soft beam edge or pattern projection, and from a spot to a flat field.

A radiation shield 86 may be attached to the plate 56 to protect the electrical leads and socket from excess heat and other undesirable radiation effects from the lamp 18.

Figure 4:
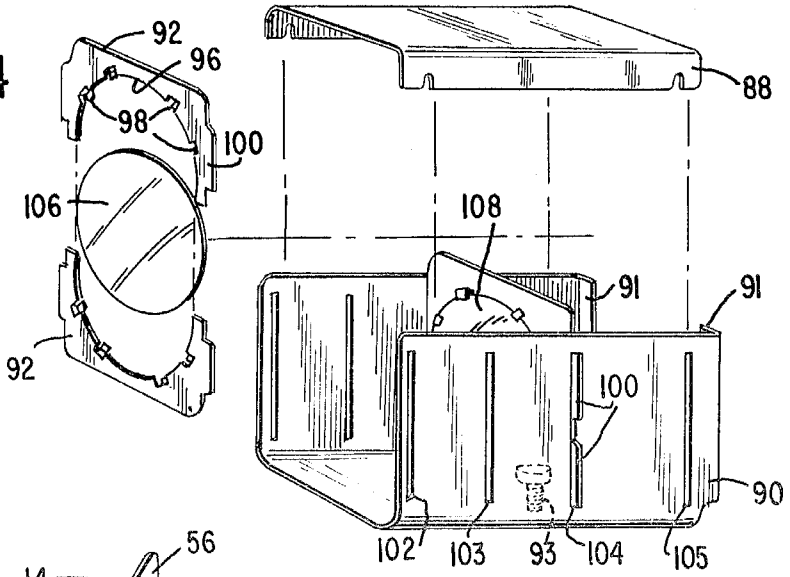
FIG. 4 is an exploded perspective view of a lens holding assembly made in accordance with the teachings of the present invention.

Referring now to FIGS. 1, 2 and 4, the lens holding assembly 22 comprises upper and lower body portions 88 and 90 releasably held together to generally conform, when assembled, to the interior shape of the housing 12. The lens holding assembly, however, is slightly smaller for insertion thereinto. Both ends of the assembly 22 are open to permit the passage of light. A plurality of lens locating slots 102–105 are in the lower body portion 90 to releasably accommodate the lens mount capture tabs. The slots are positioned as necessary or desirable depending upon the lenses chosen.

A plurality of lens mounts 92 each has a relatively large central hole 96 to accommodate a lens, a plurality of shock absorbing mounting tabs 98 to cradle each lens, and at least two lens mount capture tabs 100 on opposite sides to cooperate with the locating slots 102–105. The lens mounts may be of multiple pieces as desired.

The lower body portion 90 has an attached stud 93 which extends through the slot 32 in the housing portion 12B and has a heat insulating star-wheel 36 threaded thereonto. The easily grippable star-wheel permits an operator to selectively move and secure the lens holding assembly along the optical axis while the lamp is on, as well as remove the entire assembly without special tools.

The lens system typically consists of two plano convex lenses, a 4.5″×6.5″ objective lens 106 and a 4.5″×9″ second lens 108. (Each lens has a 4.5″ diameter. The objective lens has a 6.5″ focal length and the second lens has a 9″ focal length). Such a two-element system has short focal lengths and is simple to use. By mounting the objective lens closest to the lamp in slots 102, and moving the second lens to predetermined slots 103, 104, or 105, one may obtain respective field angles of 50°, 40°, or 30°. This versatility permits one to optimize the field illumination and field diameter as desired and still accomplish a variety of lighting effects. For instance, the beam angles are adjustable within the field to provide maximum uniformity of pattern projection. By moving the lens system one may change from a sharp to a soft edge for the illuminated area. This is accomplished by moving the focal point of the optical system away from the shutter assembly. The following chart is illustrative of the changes possible with the specified lenses, but it is to be understood that any combination of lenses may be substituted therefore as desired.

| Distance | | 7.5 | 10 | 15 | 20 | 25 | 30 |
|---|---|---|---|---|---|---|---|
| 30° | Field Diameter | 7.0 | 9.3 | 14.0 | — | — | — |
| | Illumination | 346 | 195 | 86 | — | — | — |
| 40° | Field Diameter | — | 7.3 | 10.9 | 14.6 | 18.2 | — |
| | Illumination | — | 316 | 140 | 79 | 51 | — |
| 50° | Field Diameter | — | — | 8.0 | 10.7 | 13.4 | 16.1 |
| | Illumination | — | — | 258 | 145 | 93 | 64 |

Distance is measured in feet.
Field Diameter is measured as 10% of maximum light intensity.
Illumination is measured in foot candles at beam center.
At 30° the beam candle power is 58,000.
At 40° the beam candle power is 31,600.
At 50° the beam candle power is 19,476.

Referring again to FIGS. 1 and 2, a clutch locking disk 24 is attached to the housing 12 and has a threaded post 27 extending therefrom. The yoke 26 has a similarly sized engaging disk 25 attached to the end thereof with an aperture therethrough for placement over post 27 and engagement with locking disk 24. A threaded heat insulating butterfly nut or star-wheel 23 releasably compresses the engaging and locking disks to maintain the spotlight in a desired position, which may be easily adjusted while the lamp is on. A similar clutch may be utilized on the opposite side of the housing 12, or a simple pivot mechanism may be substituted. A hole 29 in the central portion of the yoke accommodates a clamp or the like, such as a C-clamp, to attach the spotlight to a pipe.

The invention has been described in detail with particular reference to a preferred embodiment and the operation thereof, but it is understood that variations, modifications, and the substitution of equivalent mechanisms can be effected within the spirit and scope of this invention, particularly in light of the foregoing teachings. For instance, the teachings disclosed herein apply equally to an illuminator having a folded or non-linear optical axis. 9n

What is claimed is:

1. An illuminator including a housing having an optical axis;

lamp support means removably mounted to said housing for selective movement and retention generally along said optical axis;

lamp focus means removably attached to said lamp support means and moveable with respect thereto for selective generally radial movement and retention with respect to said optical axis;

an illumination source attached to said lamp focus means;

lens holding assembly removably mounted to said housing for selective movement and retention generally along said optical axis;

one or more lenses removably mounted to said lens holding assembly, each lens independently moveable with respect to said housing and each other;

light output control means removably mounted in said housing and having an access opening to receive said illumination source.

2. An illuminator as in claim 1 wherein said lamp support means includes a plate; a plurality of guards attached to and extending from said plate; and gripping means attached to said plate for manually moving said lamp support means.

3. An illuminator as in claim 1 wherein said lamp support means includes selectively operable retention means connecting said lamp support means and said housing.

4. An illuminator as in claim 3 wherein said retention means is generally manually operable and generally thermally insulating.

5. An illuminator as in claim 2 wherein said lamp focus means includes a plate; an illumination source mounting means attached to one side of said plate; selectively operable attachment means attached to the other side of said plate and removably attaching said lamp focus means and said lamp support means.

6. An illuminator as in claim 5 wherein said attachment means is generally manually operable and generally thermally insulating.

7. An illuminator as in claim 1 wherein said lens holding assembly includes a plurality of body portions generally conforming, when assembled, to the inner configuration of said housing.

8. An illuminator as in claim 1 wherein each of said lenses is independently moveable to one of a plurality of predetermined positions along said optical axis.

9. An illuminator as in claim 1 wherein said lens holding assembly includes first and second body portions having a plurality of slots at predetermined locations to selectively position said lens or lenses; and selectively operable retention means connecting said lens assembly and said housing.

10. An illuminator as in claim 9 wherein said retention means is generally manually operable and generally thermally insulating.

11. An illuminator as in claim 9 wherein said slots position said lens or lenses to create field angles of approximately 30°, 40° and 50°.

12. An illuminator as in claim 1 wherein said light output control means includes a reflector.

13. An illuminator as in claim 12 wherein said reflector is generally an ellipsoid.

14. An illuminator as in claim 1 wherein said control means may include at least one framing shutter.

15. An illuminator as in claim 1 wherein said control means includes an iris.

16. An illuminator as in claim 1 wherein control means may include at least one pattern.

17. An illuminator as in claim 1 wherein said housing has a generally rectangular cross-section as measured perpendicular to its optical axis.

* * * * *